US010502224B2

(12) United States Patent
Jang et al.

(10) Patent No.: US 10,502,224 B2
(45) Date of Patent: Dec. 10, 2019

(54) PUMP FOR CIRCULATING WATER

(71) Applicant: NEW MOTECH CO., LTD., Gwangju (KR)

(72) Inventors: Jeong Cheol Jang, Gwangju (KR); Kyoung Joo Lee, Gwangju (KR); Byung Soo Kim, Gwangju (KR); Hyun Sung Yang, Gwangju (KR)

(73) Assignee: NEW MOTECH CO., LTD., Gwangu (KR)

( * ) Notice: Subject to any disclaimer, the term of this patent is extended or adjusted under 35 U.S.C. 154(b) by 88 days.

(21) Appl. No.: 15/885,815

(22) Filed: Feb. 1, 2018

(65) Prior Publication Data

US 2018/0266430 A1 Sep. 20, 2018

(30) Foreign Application Priority Data

Mar. 20, 2017 (KR) ..... 10-2017-0034935

(51) Int. Cl.

| | |
|---|---|
| ***F04D 29/22*** | (2006.01) |
| ***F04D 29/42*** | (2006.01) |
| ***F04D 31/00*** | (2006.01) |
| ***F04D 29/66*** | (2006.01) |
| ***F04D 13/06*** | (2006.01) |

(52) U.S. Cl.

CPC ..... *F04D 29/2266* (2013.01); *F04D 13/0653* (2013.01); *F04D 29/426* (2013.01); *F04D 29/669* (2013.01); *F04D 31/00* (2013.01)

(58) Field of Classification Search

CPC .... F04D 29/047; F04D 29/2266; F04D 29/24; F04D 29/242; F04D 29/426; F04D 29/5806; F04D 29/66; F04D 29/669; F04D 13/06; F04D 13/0606; F04D 13/0653; F04D 31/00; B01F 3/04539

See application file for complete search history.

(56) References Cited

U.S. PATENT DOCUMENTS

2006/0263200 A1* 11/2006 Ahlroth ..... F04D 29/2266 415/58.2
2016/0025095 A1* 1/2016 Hattori et al. ..... F01P 5/12 417/423.12

(Continued)

FOREIGN PATENT DOCUMENTS

KR 10-1996-0011157 A 4/1996
KR 10-2011-0014282 A 2/2011

(Continued)

*Primary Examiner* — Jason D Shanske
*Assistant Examiner* — Elton K Wong
(74) *Attorney, Agent, or Firm* — Revolution IP, PLLC

(57) ABSTRACT

A pump for circulating water includes an upper housing formed with an inlet and an outlet of fluid; a lower housing installed to fit in a lower side of the upper housing, having a receiving space formed therein; an inner housing having an edge part interposed between the upper housing and the lower housing, an impeller receiving groove formed therein, and a shaft support part formed at the center of the bottom of the impeller receiving groove; an impeller received in the impeller receiving groove to be rotatably installed, so as to form a flow pathway between the impeller and an inner surface of the inner housing for the flow of fluid; a rotor installed inside the impeller; and a stator installed in the lower housing to be positioned to face the rotator.

6 Claims, 7 Drawing Sheets

(56) References Cited

U.S. PATENT DOCUMENTS

| | | | | |
|---|---|---|---|---|
| 2017/0089359 | A1* | 3/2017 | Lin | F04D 13/0673 |
| 2017/0159669 | A1* | 6/2017 | Fang | F04D 13/0606 |

FOREIGN PATENT DOCUMENTS

| | | | |
|---|---|---|---|
| KR | 10-1204344 | B1 | 11/2012 |
| KR | 10-2015-0085241 | A | 7/2015 |
| KR | 10-1712604 | B1 | 2/2017 |

* cited by examiner (a)

(b)

PUMP FOR CIRCULATING WATER

BACKGROUND

The present invention relates to a pump for circulating water, more specifically to a pump for circulating water which prevents the rise of an impeller by an inner pressure generated when the pump for circulating water operates, secures smooth flow of fluid by preventing the impeller from being affected by an air pressure generated while discharging, to a fluid outlet, part of the fluid and air intruding into the lower part of a pump chamber, thereby allowing smooth rotation of the impeller, and improves durability by preventing damage of the impeller.

In general, pumps for circulating water used as feed water pumps of low pressure boilers use centrifugal pumps, and these pumps are disclosed in prior art, Korean Patent No. 10-1204344. Said patent provides a technology of rotating an impeller installed with a rotor by the electromagnetic induction between a stator and the rotor to introduce fluid (water) to the inlet of a lower part of the reservoir, discharging the fluid (water) through a pathway between a wing piece of an impeller body and an upper cover of the impeller by pumping, and delivering the introduced fluid along a discharge line via an outlet to a place of use such as a heating mat, etc. through a connecting line after heating the fluid by a heating means.

In particular, in the prior art, a plurality of discharge holes vertically penetrating the impeller to be interconnected with the flow pathway are formed so that the fluid in the flow pathway formed between an outer surface of the impeller body and an impeller receiving groove of the inner housing is discharged upwards.

Therefore, according to the prior art, during the pumping action of the impeller, part of the water (part of the fluid) discharged through the pathway between the wing piece and the impeller upper cover and air included therein are smoothly discharged upwards while being introduced into the flow pathway formed between the outer surface of the impeller body and the impeller receiving groove of the inner housing and the discharge holes vertically penetratingly formed through the impeller body. Thus, since cavitation does not occur in the flow pathway even during high speed rotation of the impeller, water is circulated smoothly. Also, since the rise of the impeller is prevented, the vibration or noise can be blocked which is generated from the contact with the inner surface of the upper housing or adjacent parts because of the rise of the impeller.

However, part of water and air introduced into the flow pathway rises through the plurality of discharge holes which vertically penetrate the impeller during the driving of the impeller and are discharged through the wing piece of the impeller. Thus, the pressure of part of water rising along the discharge holes is applied to the wing piece of the impeller, thereby causing a great difference in pressure between the front and the back of the wing piece of the impeller during high speed rotation. Accordingly, the action bothering the rotation may occur, which blocks the rotation of the wing piece of the impeller.

Therefore, there are problems such that the fluid does not flow smoothly because of reduction of a rotating force of the impeller, and that the durability of the impeller is greatly lowered because of damage to the wing piece of the impeller caused thereby as well as generation of noise and excessive vibration.

SUMMARY

It is an object of the present invention to provide a pump for circulating water allowing fluid which is gathered at a lower part of the impeller and causes malfunction and noise to be discharged smoothly.

The object and other inherent objects could easily be achieved by the present invention which will be explained below.

The pump for circulating water according to the present invention includes an upper housing 10 formed with an inlet 11 and an outlet 12 of fluid; a lower housing 20 installed to fit in a lower side of the upper housing 10, having a receiving space formed therein; an inner housing 30 having an edge part interposed between the upper housing 10 and the lower housing 20, an impeller receiving groove 31 formed therein, and a shaft support part 32 formed at the center of the bottom of the impeller receiving groove 31; an impeller 50 received in the impeller receiving groove 31 to be rotatably installed, so as to form a flow pathway 40 between the impeller 50 and an inner surface of the inner housing 30 for the flow of fluid; a rotor 60 installed inside the impeller 50; and a stator 70 installed in the lower housing 20 to be positioned to face the rotor 60, wherein the pump for circulating water is formed with a plurality of pressure alleviating through holes 54A in a base plate 54 in which a wing piece 53 of the impeller 50 is formed, a plurality of vertical discharge holes 52A in a body 51 of the impeller 50, interconnected with the flow pathway 40, so that the fluid inside the flow pathway 40 is discharged to the upper side, and a plurality of horizontal discharge holes 52B at a side of the impeller body 51 between a lower part of the base plate 54 and an upper part of a rotor receiving part 61 having a rotor receiving space, wherein the pressure alleviating through holes 54A, the plurality of vertical discharge holes 52A and the plurality of horizontal discharge holes 52B are formed to be interconnected with each other, and the fluid inside the flow pathway 40 rising through the vertical discharge hole 52A and the horizontal discharge hole 52B and the fluid introduced through the inlet 11 are mixed in a mixture space S and discharged through the outlet 12.

According to the present invention, it is preferable that the horizontal discharge hole 52B is in the form of a slot hole or a rectangle.

According to the present invention, a spiral discharge groove 52A' may be formed in an inner circumferential surface of the vertical discharge hole 52A.

According to the present invention, a fluid guide recess 51*d*' for guiding part of fluid and air coming out of the vertical discharge hole 52A may be formed in an outer surface of one side of the horizontal discharge hole 52B in a middle body 51*d* of the impeller 50.

According to the present invention, it is preferable that the plurality of pressure alleviating through holes 54A, the plurality of vertical discharge holes 52A and the plurality of horizontal discharge holes 52B are formed at points having the same radius with respect to a shaft insertion hole 51*a* of the impeller body 51.

The present invention provides the plurality of pressure alleviating through holes formed in the base plate of the impeller and the plurality of horizontal discharge holes interconnected with the plurality of vertical discharge holes, allowing the inner pressure of an upper part, a middle part and a lower part inside the pump chamber to be reduced, so as to avoid factors of rising the impeller by the inner pressure generated during the driving of the impeller. Thereby, noise resulting from the contact between the upper cover of the impeller and the inner side of the upper housing can be prevented, and at the same time, damage of the impeller can be prevented.

The present invention discharges part of water and air intruding into the flow pathway to the side of the impeller body to be discharged through the outlet, while being mixed. Accordingly, the wing piece of the impeller can rotate smoothly without any rotation blocking pressure, and the difference in water pressure of the pump can be constantly maintained. Thereby, damage to the impeller can be prevented, and durability of the impeller can be greatly improved.

Additionally, the present invention can smoothly rotate the wing piece and prevent excessive vibration or noise generated from the wing piece because there is no pressure of water inside the flow pathway applied to the wing piece of the impeller.

Also, the present invention swiftly discharges part of water inside the flow pathway to the side of the impeller body by a suction force generated by the driving of the impeller regardless of the wing piece of the impeller, allowing the part of water to be discharged through the outlet, while being mixed. Thereby, the fluid can smoothly flow, and noise resulting from generation of bubbles can be inhibited, so as to increase efficiency of the pump.

DETAILED DESCRIPTION

Hereinafter, embodiments of the present invention are explained in detail with reference to the attached drawings.

Figure 1:
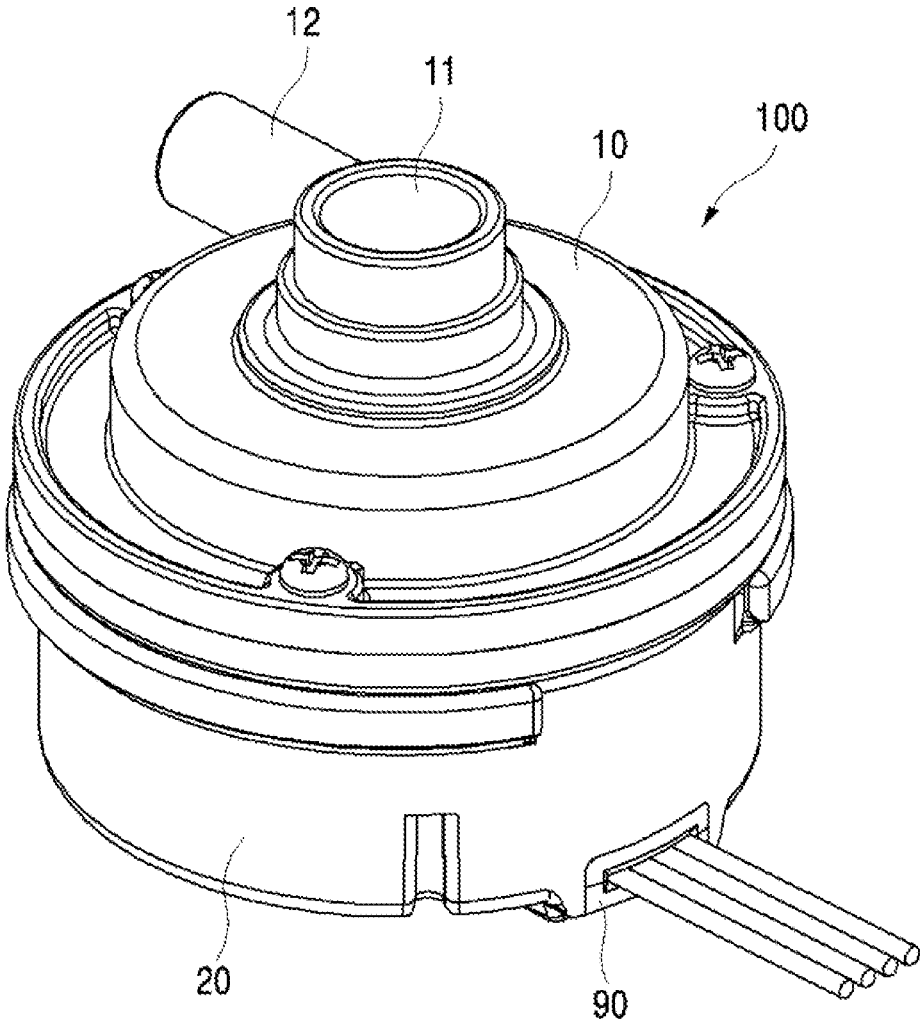
FIG. 1 is a perspective view illustrating a pump for circulating water according to the present invention.
Figure 2:
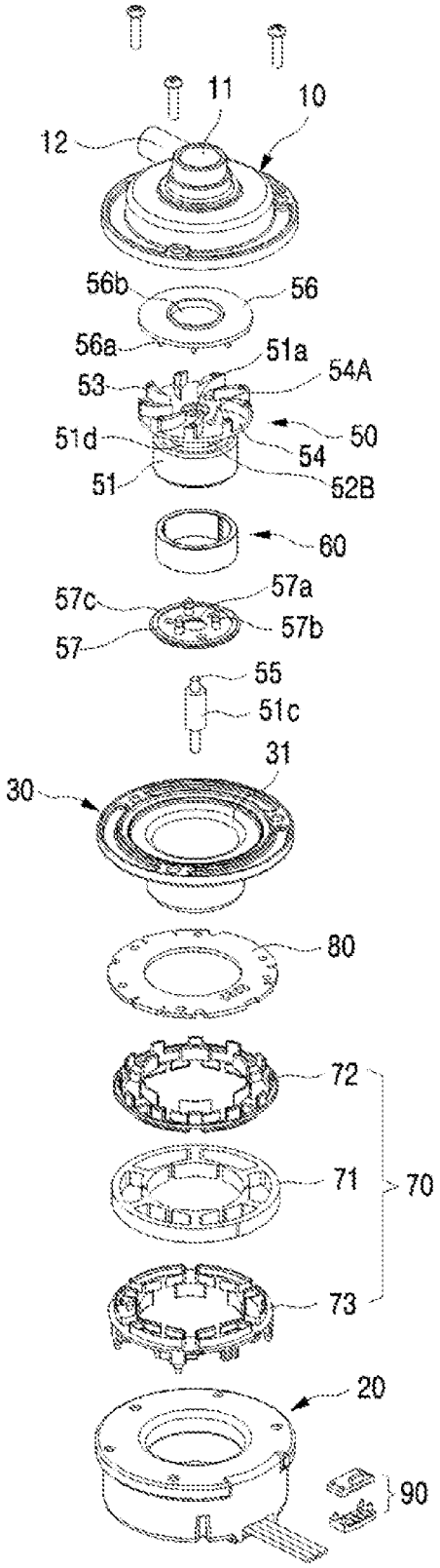
FIG. 2 is an exploded perspective view illustrating the pump for circulating water according to the present invention.
Figure 3:
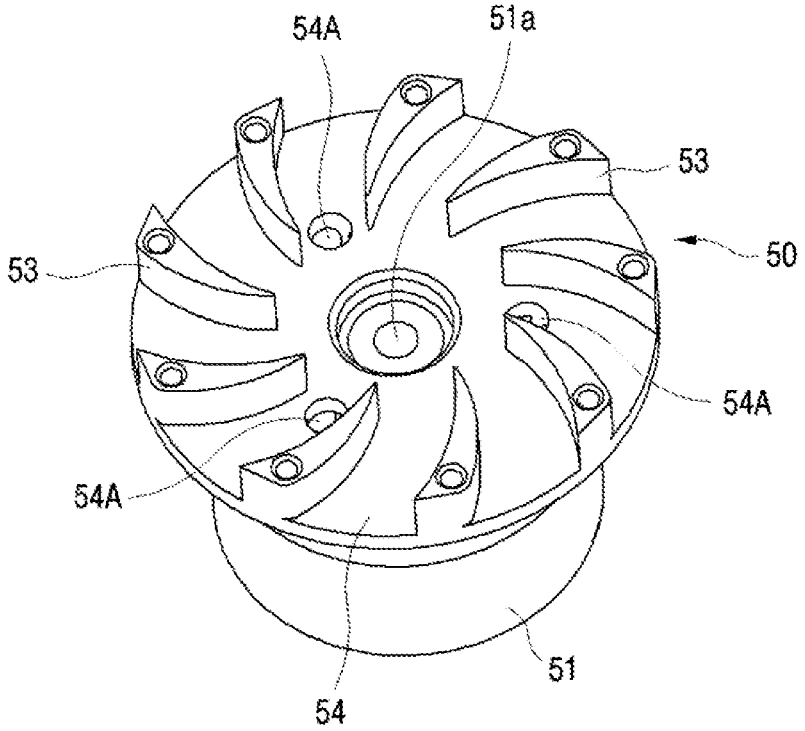
FIG. 3 is a perspective view illustrating an impeller of a pump for circulating water according to the present invention.
Figure 4:
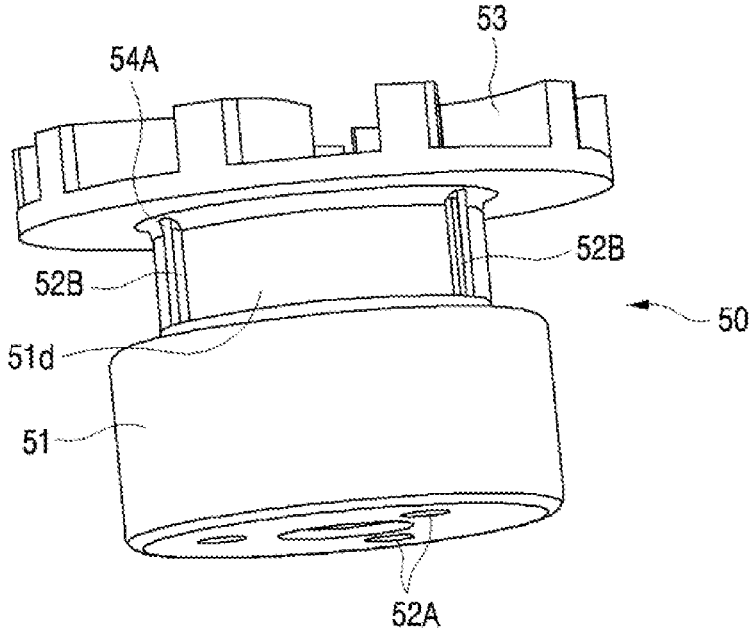
FIG. 4 is a perspective view of the impeller of a pump for circulating water according to the present invention, as seen from the side.
Figure 5:
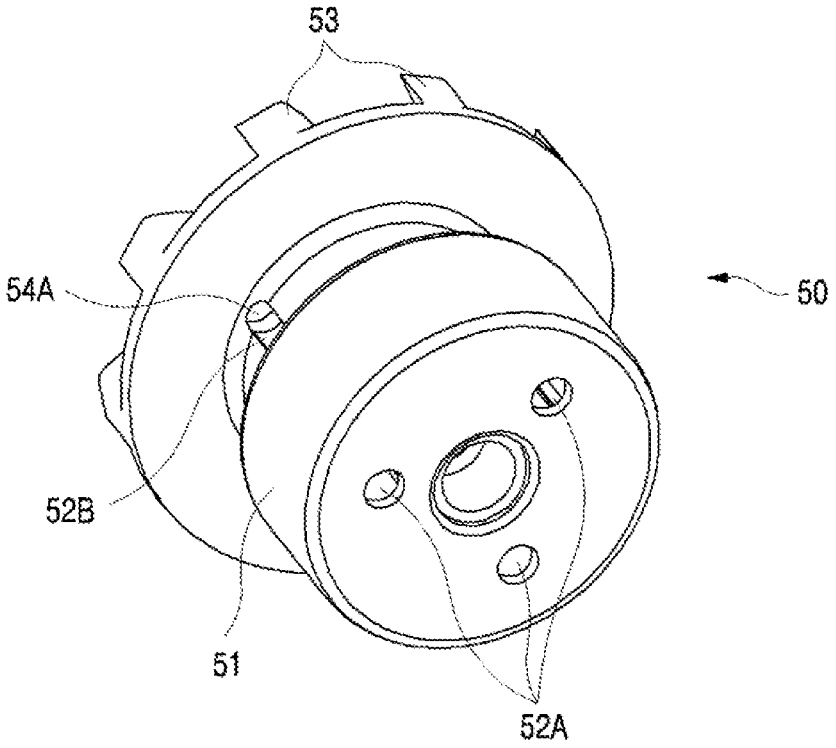
FIG. 5 is a perspective view of the impeller of a pump for circulating water according to the present invention, as seen from the bottom.
Figure 6:
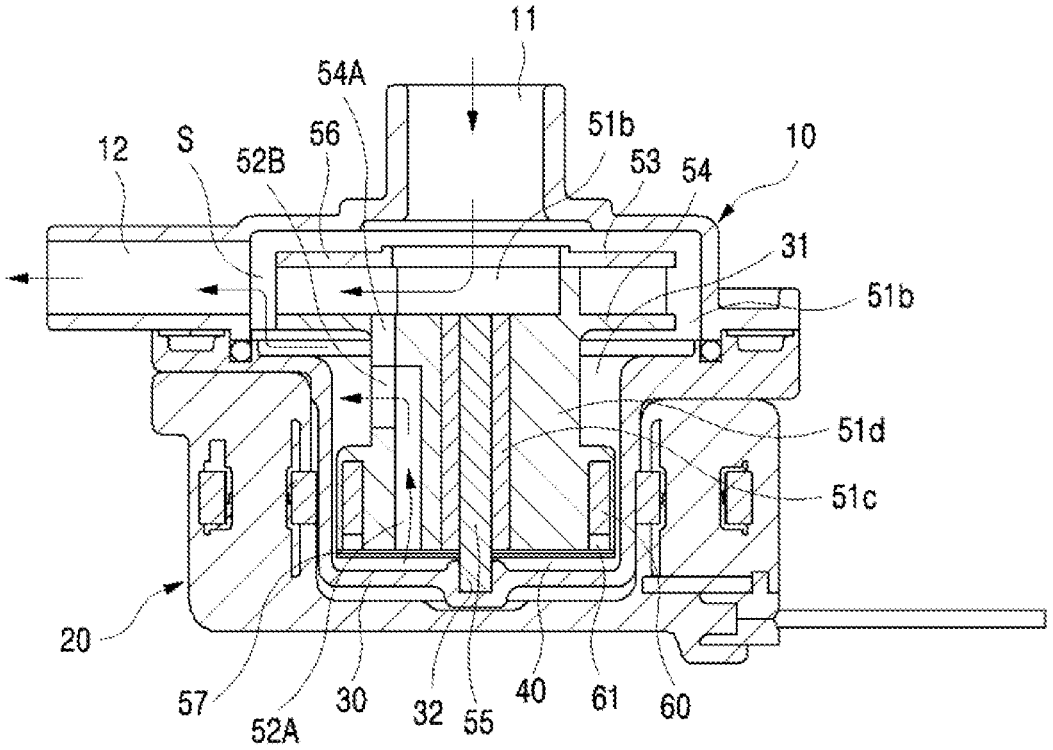
FIG. 6 is a cross-sectional view illustrating a pump for circulating water according to the present invention, taken along the longitudinal direction.

With reference to FIG. 1 and FIG. 2, a pump for circulating water 100 according to the present invention includes an upper housing 10, a lower housing 20, an inner housing 30, an impeller 50, a rotor 60 and a stator 70.

The upper housing 10 is formed with an inlet 11 and an outlet 12 of fluid, and supports the top of a rotation shaft 55 from the inside of the middle part. The lower housing 20 is installed to fit in the bottom of the upper housing 10, and has the stator 70 installed therein. The inner housing 30 has an edge part interposed between the upper housing 10 and the lower housing 20, and an impeller receiving groove 31 in which the impeller 50 is positioned. A shaft support part 32 which supports the bottom of the rotation shaft 55 is formed at the center of the bottom of the impeller receiving groove 31. The impeller 50 is received inside the upper housing 10 and in the impeller receiving groove 31 of the inner housing 30 to be rotatably installed, so as to form a flow pathway 40 between the impeller 50 and the inner housing 30. The rotor 60 is installed in a rotor receiving groove 61 at the bottom of the impeller 50. The stator 70 is installed in the lower housing 20 to be positioned to face the rotor 60.

As illustrated in FIG. 3 to FIG. 7, the pump for circulating water according to the present invention is formed with a plurality of pressure alleviating through holes 54A in a base plate 54 in which a wing piece 53 of the impeller 50 is formed, and a plurality of vertical discharge holes 52A in a body 51 of the impeller 50, interconnected with the flow pathway 40, so that the fluid inside the flow pathway 40 is discharged to the upper side. The pressure alleviating through holes 54A are formed at the side of a middle body 51*d* located between the lower part of the base plate 54 in which the wing piece 53 of the impeller 50 is formed and the body 51 which includes the rotor receiving part 61 in which the rotor is received. Additionally, a plurality of horizontal discharge holes 52B interconnected with the plurality of vertical discharge holes 52A are formed at the side of the middle body 51*d*. As such, the present invention can have a structure where an impeller part performing a pumping action and a driving part including a stator and a rotor are installed inside the upper housing 10 and lower housing 20.

The upper housing 10 has the inlet 11 and outlet 12 of fluid, and is formed with an upper shaft support part at the center of the inside of the upper housing 10. The inlet 11 has a shape of a circular cap protruding from the center of the outside of the upper housing 10. The outlet 12 has a protruding shape at the side of the wing piece 53 of the impeller 50. In other words, the inlet 11 protrudes, in the shape of a pipe, upwards from the center of the upper housing 10, and the outlet 12 protrudes, in the shape of a pipe, in a direction perpendicular to the inlet 11 to be interconnected with the inner space in which the impeller 50 is positioned. The edge of the upper housing 10 has a flange structure to be fastened with the inner housing 30.

The lower housing 20 is installed below the upper housing 10. The lower housing 20 has a space in which the inner housing 30 is positioned. The stator 70 and a printed circuit board 80 are formed in the lower housing 20. It is preferable to have the stator 70 and the printed circuit board 80 positioned in an insert injection mold and then have the lower housing 20 formed by injection molding so as to integrally form the stator 70 and the lower housing 20.

The inner housing 30 is installed between the upper housing 10 and the lower housing 20, and the impeller receiving groove 31 which is a space where the impeller 50 is received is formed at the center of the inner housing 30. The shaft support part 32 is formed at the center of the bottom inside the impeller receiving groove 31, and the lower part of the rotation shaft 55 is fixed and coupled to the shaft support part 32.

The impeller 50 includes the impeller body 51, the rotation shaft 55 coupled to the center of the impeller 50, and an impeller upper cover 56 and an impeller lower cover 57 installed in the upper part and lower part of the impeller 50. The impeller 50 is positioned inside the upper housing 10 and on the impeller receiving groove 31 of the inner housing 30, to be rotatably inserted into the rotation shaft 55. The flow pathway 40 is formed between the outside of the impeller body 51 and the inside of the inner housing 30. The impeller 50 performs a pumping action of the fluid. In other words, part of fluid (water) is introduced into the flow pathway 40 through an inlet groove 51*b* formed between side of the top of the impeller 50 and the inner housing 30.

A shaft insertion hole 51*a* is vertically penetrated into the impeller body 50 formed in a cylinder shape, and the rotor 60 is filled and received in the rotor receiving groove 61 formed inside the impeller body 51. The plurality of wing pieces 53 are formed in the upper base plate 54 of the impeller body 51. Additionally, a fastening hole for fastening the impeller upper cover 56 is formed in the upper surface of the wing piece 53. A shaft support member 51*c* for supporting rotation of the impeller 50 is fixedly inserted into the shaft insertion hole 51*a* of the impeller 50. The impeller rotation shaft 55 is coupled to the inside of the shaft support member 51*c* and is installed to support the rotation of the impeller 50.

With reference to FIG. 2, the impeller upper cover 56 is formed with a coupling boss 56*a* on the lower surface of the body having a circular plate shape to be inserted into the fastening hole in the wing piece 53, and a through hole 56*b* interconnected with the inlet 11. The impeller lower cover 57 is coupled to the bottom of the impeller body 51 so as to seal the rotor receiving space 61. Reference numeral 57*a* refers to a rotation shaft passing hole through which the rotation shaft passes, reference numeral 57*b* refers to a protrusion to be coupled to the bottom of the impeller body 51, and reference numeral 57*c* refers to a fluid passing hole interconnected with the vertical discharge hole 52A, through which fluid passes.

The rotor 60 is installed inside the outer circumference of the impeller 50. The rotor is formed of a magnet in the shape of a circular ring magnetized with the north polar and the south polar repetitively, so as to be installed in the rotor receiving part 61 of the impeller body 51.

The stator 70 is positioned to face the rotor 60 for electromagnetic induction with the rotor 60. The stator 70 includes a core 71, an upper core support member 72 coupled to the upper part to support the upper side of the core 71, and a lower core support member 73 coupled to the lower part to support the lower side of the core 71. The core 71 is formed such that a plurality of core teeth protrude towards the inside of the body having the overall shape of an approximately circular ring shape. The upper core support member 72 and lower core support member 73, which are the upper surface and lower surface of ring-shaped circular plate, have a plurality of guide projections. Around the core teeth, coils (not illustrated) are wound.

When conventional pumps perform input and discharge of fluid, part of the fluid input and air included in the fluid intrude into the flow pathway 40 to be collected in the lower part of the outside of the impeller body 51. At that time, bubbles occur because of the collected fluid when driving the pump, and accordingly noise and excessive vibration may be generated, thereby deteriorating the efficiency of the pump. Particularly, the impeller 50 rises by the difference in pressure inside the pump chamber when driving the pump, and thus the upper surface of the upper cover 56 fastened to the top of the impeller 50 contacts the inner surface of the upper housing 10, which causes abnormal noises. In order to solve the above problem, the present invention is formed with the plurality of pressure alleviating through holes 54A in the base plate 54 in which the wing piece 53 of the impeller 50 is formed, the plurality of vertical discharge holes 52A in the body 51 of the impeller 50, interconnected with the flow pathway 40, so that the fluid in the flow pathway 40 is discharged to the upper side, and the plurality of horizontal discharge holes 52B in the middle body 51*d* of the impeller 50 between the lower part of the base plate 54 in which the wing piece 53 of the impeller is formed and the upper part of the rotor receiving part 61 having the rotor receiving space, interconnected with the pressure alleviating through holes 54A and the plurality of vertical discharge holes 52A.

It is preferable that the plurality of horizontal discharge holes 52B are in the form of a slot hole or a rectangle in the longitudinal direction. Thereby, part of fluid and air inside the flow pathway 40 may be more swiftly discharged. Furthermore, it is more preferable that the slot hole or rectangle has a length in the longitudinal direction from the lower part of the base plate 54 to the upper part of the rotor receiving part 61. In other words, it is preferable that said length is almost the same as the length of the middle body 51.

The plurality of pressure alleviating through holes 54A, the plurality of vertical discharge holes 52A, and the plurality of horizontal discharge holes 52B are interconnected with each other. Accordingly, the pressures in the space of the wing piece 53 of the impeller 50, the space around the middle body 51*d* of the impeller 50, and the space inside the lower flow pathway 40 are equally distributed to overcome the issue of pressure inside the pump chamber. Thereby, the rise of the impeller 50 by the pressure generated when driving the pump can be prevented, and any interference by contact with the internal components between the impeller 50, the upper housing 10 and lower housing 20, and the inner housing 30 can be avoided, so as to inhibit the generation of abnormal noises. Particularly, the plurality of pressure alleviating through holes 54A in the base plate 54 of the impeller 50 may be formed at points having the same radius with respect to the shaft insertion hole 51*a* of the impeller body 51. For example, it is preferable to form three pressure-alleviating through holes 54A with the separation angle of 120° between the pressure-alleviating through holes 54A. Thereby, the impeller 50 may not be eccentric to any one side. Further, due to the plurality of pressure alleviating through holes 54A, a total weight of the impeller 50 may be lightened, thereby greatly increasing a rotating force of the impeller 50.

Even with the pressure alleviating through holes 54A formed in the base plate 54 of the impeller 50, the fluid introduced to the inside of the inner housing 30 may be inhibited to the minimum since when the impeller 50 rotates at a high speed, the fluid introduced through the inlet 11 is discharged to the outlet 12 while being rotated by the wing piece 53. The fluid inside the flow pathway 40 rising through the horizontal discharge holes 52B and the fluid introduced through the inlet 11 may be mixed in a mixture space S and discharged through the outlet 12.

While raising part of the fluid and air residing in the flow pathway 40 through the plurality of vertical discharge holes 52A and the plurality of horizontal discharge holes 52B interconnected therewith by a suction force generated from the rotation of the wing piece 53 during the high speed rotation of the impeller 50, they are mixed with the fluid introduced through the inlet 11 and discharged through the outlet 12, thereby performing smooth circulation of the fluid, and preventing the rising of the impeller 50 by inhibiting the generation of bubbles and cavitation, etc. Also, since the fluid inside the flow pathway 40 is discharged through the mixing space S without colliding with the wing piece 53 of the impeller 50, excessive vibration or noise can be reduced, and also the durability can be improved by avoiding damage to the impeller 50. Further, through smooth flow of fluid, the water pressure difference between the upper part and the lower part of the impeller 50 can be made the same, thereby greatly improving the efficiency of the pump.

The plurality of vertical discharge holes 52A and the plurality of horizontal discharge holes 52B are formed at points having the same radius with respect to the shaft insertion hole 51*a* of the impeller body 51, with the separation angle of 120°, for example, not to cause an eccentric rotation during the rotation of the impeller 50, thereby preventing abrasion or damage of components.

Figure 7:
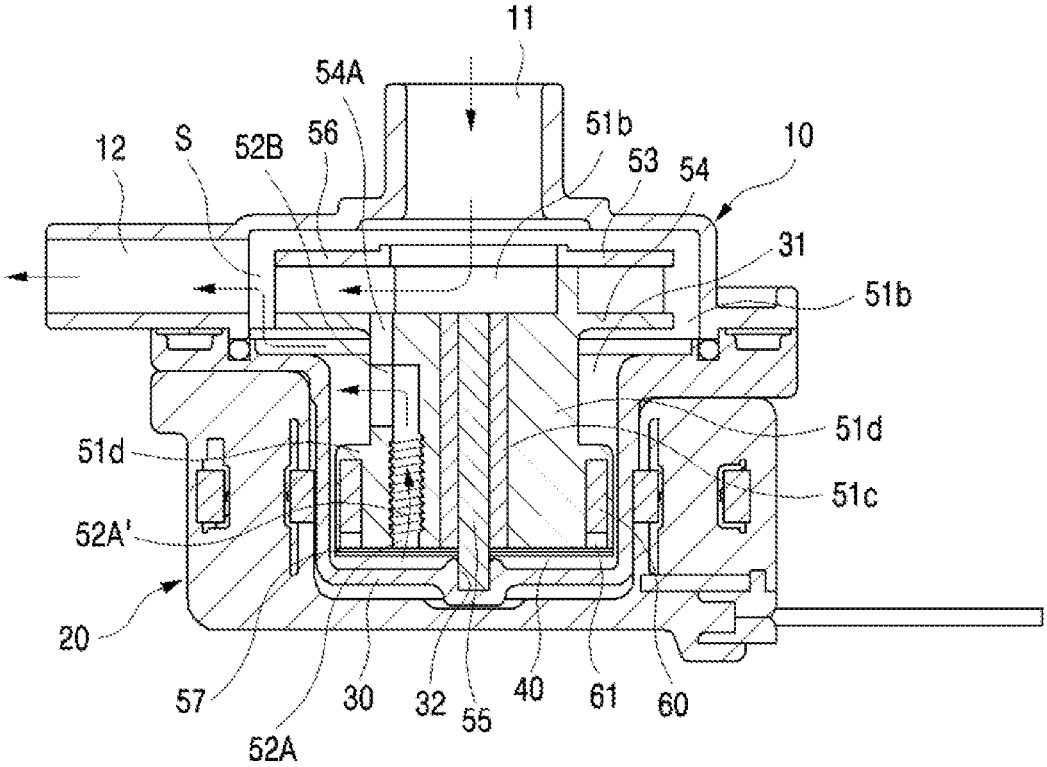
FIG. 7 is a cross-sectional view illustrating the pump for circulating water according to the present invention in FIG. 6, in which a spiral discharge groove is formed in an inner circumferential surface of a vertical discharge hole.

As illustrated in FIG. 7, the present invention may form a spiral discharge groove 52A' in an inner circumferential surface of the vertical discharge hole 52A. In this case, the air or water inside the flow pathway 40 may be more smoothly discharged along the spiral discharge groove 52A'.

Figure 8:
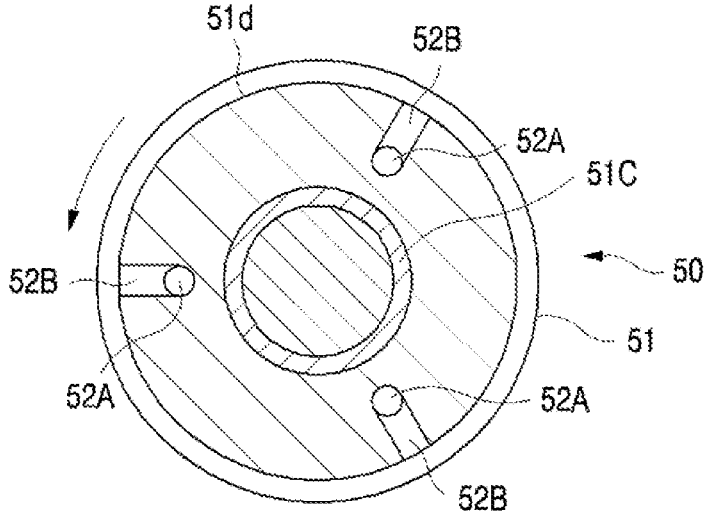
FIG. 8 is a cross-sectional view illustrating an impeller of a pump for circulating water according to the present invention, taken along the horizontal direction.
Figure 8:
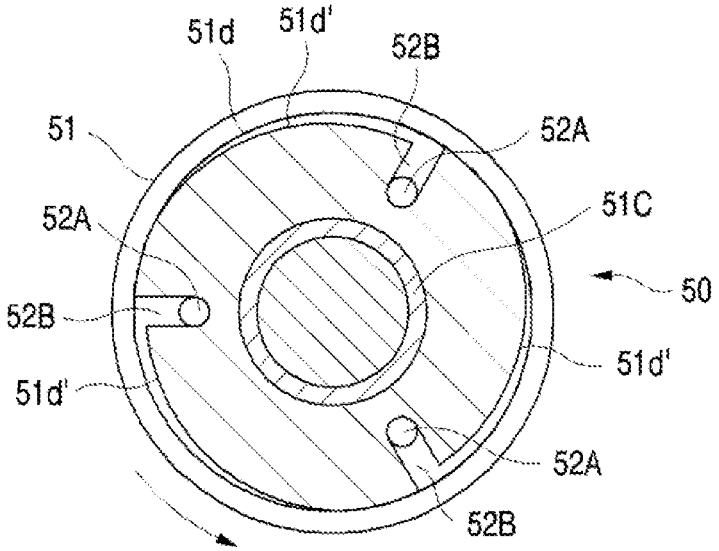

FIG. 8 is a cross-sectional view of the middle body 51*d* of the impeller 50 according to the present invention, taken along the horizontal direction. FIG. 8(*a*) is a cross-sectional view of the impeller 50 of FIG. 3, and FIG. 8(*b*) is a cross-sectional view of the impeller 50 in which the fluid guide recess 51*d*' is formed in the middle body 51*d*.

As illustrated in FIG. 8(*b*), the present invention may form the fluid guide recess 51*d*' for guiding part of fluid coming out of the vertical discharge hole 52A in the outer surface of the middle body 51*d* connected with the horizontal discharge hole 52B formed in the middle body 51*d* of the impeller 50.

It is preferable to form the fluid guide recess 51*d*' in the rotation direction of the impeller 50. When the part of fluid and air coming out of the vertical discharge hole 52A are discharged through the horizontal discharge hole 52B during the driving of the impeller 50, the part of fluid and air inside the flow pathway 40 are guided along the fluid guide recess 51*d*' to be discharged to the mixture space S. Thereby, swift discharge can be made.

As explained above, the present invention explains the pump for circulating water 100 performing the pumping action, which circulates heated water to a place of use such as a heating mat, etc. However, it is obvious to a person skilled in the art that the present invention also applies to a circulating pump performing input and discharge of fluid, not water.

Although the present invention is described as above with reference to embodiments, the embodiments are merely examples and do not limit the present invention. Also, it should be understood that various modifications and applications which are not exemplified in the above can be made by those skilled in the art within a scope not deviating from the essential properties of the present embodiments. In addition, it should be interpreted that differences associated with such modifications and applications fall within the scope of the present invention as prescribed by the appended claims.

What is claimed is:

1. A pump for circulating water, comprising:

an upper housing formed with an inlet and an outlet for a flow of fluid;

a lower housing installed to fit in a lower side of the upper housing, the lower housing having a receiving space formed therein;

an inner housing having an edge part interposed between the upper housing and the lower housing, an impeller receiving groove formed at the center of the inner housing, and a shaft support part formed at the center of the bottom of the impeller receiving groove;

an impeller received in the impeller receiving groove to be rotatably installed, so as to form a flow pathway between the impeller and an inner surface of the inner housing for the flow of fluid;

a rotor installed inside the impeller; and a stator installed in the lower housing to be positioned to face the rotor, wherein the pump for circulating water is formed with a plurality of pressure alleviating through holes in a base plate in which a wing piece of the impeller is formed, a plurality of vertical discharge holes in a body of the impeller, interconnected with the flow pathway, so that the fluid inside the flow pathway is discharged to the upper side, and a plurality of horizontal discharge holes at a side of the impeller body between a lower part of the base plate and an upper part of a rotor receiving part having a rotor receiving space, wherein the pressure alleviating through holes, the plurality of vertical discharge holes and the plurality of horizontal discharge holes are formed to be interconnected with each other, and the fluid inside the flow pathway rising through the vertical discharge hole and the horizontal discharge hole and the fluid introduced through the inlet are mixed in a mixture space and discharged through the outlet.

2. The pump for circulating water of claim 1, wherein the horizontal discharge hole is in the form of a slot hole or a rectangle.

3. The pump for circulating water of claim 1, wherein a spiral discharge groove is formed in an inner circumferential surface of the vertical discharge hole.

4. The pump for circulating water of claim 1, wherein a fluid guide recess for guiding part of fluid and air coming out of the vertical discharge hole is formed in an outer surface of one side of the horizontal discharge hole.

5. The pump for circulating water of claim 1, wherein the plurality of pressure alleviating through holes, the plurality of vertical discharge holes and the plurality of horizontal discharge holes are formed at points having the same distance from a shaft insertion hole of the impeller body.

6. The pump for circulating water of claim 2, wherein a fluid guide recess for guiding part of fluid and air coming out of the vertical discharge hole is formed in an outer surface of one side of the horizontal discharge hole.

* * * * *